US011688941B2

(12) United States Patent
Vilenskiy et al.

(10) Patent No.: US 11,688,941 B2
(45) Date of Patent: Jun. 27, 2023

(54) ANTENNA DEVICE FOR BEAM STEERING AND FOCUSING

(71) Applicant: SAMSUNG ELECTRONICS CO., LTD., Suwon-si (KR)

(72) Inventors: Artem Rudolfovitch Vilenskiy, Moscow (RU); Mikhail Nikolaevich Makurin, Moscow region (RU); Chongmin Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 134 days.

(21) Appl. No.: 17/051,387

(22) PCT Filed: Aug. 26, 2019

(86) PCT No.: PCT/KR2019/010840
§ 371 (c)(1),
(2) Date: Oct. 28, 2020

(87) PCT Pub. No.: WO2020/040624
PCT Pub. Date: Feb. 27, 2020

(65) Prior Publication Data

US 2021/0234269 A1 Jul. 29, 2021

(30) Foreign Application Priority Data

Aug. 24, 2018 (RU) ..... 2018130706

(51) Int. Cl.
*H01Q 3/00* (2006.01)
*H01Q 3/36* (2006.01)
(Continued)

(52) U.S. Cl.
CPC ..... *H01Q 3/36* (2013.01); *H01Q 3/26* (2013.01); *H01Q 3/30* (2013.01); *H01Q 3/38* (2013.01)

(58) Field of Classification Search
CPC .. H01Q 3/36; H01Q 3/26; H01Q 3/30; H01Q 3/38
(Continued)

(56) References Cited

U.S. PATENT DOCUMENTS 3,971,022 A 7/1976 Lenz
4,381,509 A 4/1983 Rotman et al.
(Continued)

FOREIGN PATENT DOCUMENTS

CN 103094713 A 5/2013
CN 107645070 A 1/2018
(Continued)

OTHER PUBLICATIONS

Communication dated Jun. 7, 2021, from the European Patent Office in European Application No. 19852744.2.
(Continued)

*Primary Examiner* — Chuong P Nguyen
(74) *Attorney, Agent, or Firm* — Sughrue Mion, PLLC

(57) ABSTRACT

Provided is an antenna apparatus including: a signal splitter configured to generate a second signal including N equal-phase signals by splitting a first signal received from a signal source; a signal source virtual beam adjustor configured to generate a third signal including N signals by shifting a phase of each signal included in the second signal; a transmission beam adjustor configured to generate a fourth signal including N signals by shifting a phase of each signal included in the third signal by 0 degree or 180 degrees; and a transmitter including N transmission antennas transmitting respectively transmitting the N signals included in the fourth signal.

20 Claims, 14 Drawing Sheets

(51) Int. Cl.
*H01Q 3/26* (2006.01)
*H01Q 3/30* (2006.01)
*H01Q 3/38* (2006.01)

(58) Field of Classification Search
USPC ..... 342/372, 368
See application file for complete search history.

(56) References Cited

U.S. PATENT DOCUMENTS

| | | | | |
|---|---|---|---|---|
| 4,388,626 | A | 6/1983 | Gans | |
| 4,460,897 | A | 7/1984 | Gans | |
| 4,825,216 | A | 4/1989 | DuFort | |
| 4,937,584 | A | 6/1990 | Gabriel et al. | |
| 4,951,061 | A | 8/1990 | Lee | |
| 5,041,849 | A | 8/1991 | Quate et al. | |
| 5,214,438 | A | 5/1993 | Brusgard et al. | |
| 5,734,349 | A | 3/1998 | Lenormand et al. | |
| 5,793,798 | A * | 8/1998 | Rudish | H01Q 3/30 375/138 |
| 5,929,804 | A | 7/1999 | Jones et al. | |
| 6,351,240 | B1 | 2/2002 | Karimullah et al. | |
| 6,690,333 | B2 | 2/2004 | Eiges | |
| 7,212,153 | B2 | 5/2007 | Rowe et al. | |
| 7,554,508 | B2 * | 6/2009 | Johnson | H03D 7/00 343/893 |
| 7,923,273 | B2 | 4/2011 | Dutta | |
| 8,284,102 | B2 | 10/2012 | Hayes et al. | |
| 8,456,351 | B2 | 6/2013 | Kam et al. | |
| 8,477,408 | B2 | 7/2013 | Li | |
| 8,487,268 | B2 | 7/2013 | Gerthsen et al. | |
| 9,482,796 | B2 | 11/2016 | Arbabi et al. | |
| 9,660,339 | B2 * | 5/2017 | Li | H01Q 21/061 |
| 10,069,213 | B2 * | 9/2018 | Song | H01Q 5/42 |
| 10,756,445 | B2 * | 8/2020 | Chen | H01Q 21/245 |
| 10,983,413 | B2 * | 4/2021 | Shin | G02F 1/2955 |
| 2003/0108291 | A1 | 6/2003 | Duveneck et al. | |
| 2004/0052489 | A1 | 3/2004 | Duveneck et al. | |
| 2006/0097916 | A1 | 5/2006 | Bogosanovic | |
| 2006/0273255 | A1 | 12/2006 | Volkov et al. | |
| 2007/0001918 | A1 | 1/2007 | Ebling et al. | |
| 2008/0129595 | A1 | 6/2008 | Choi et al. | |
| 2009/0289863 | A1 | 11/2009 | Lier | |
| 2011/0074646 | A1 * | 3/2011 | Snow | H01Q 19/28 343/850 |
| 2014/0085693 | A1 | 3/2014 | Mosallaei et al. | |
| 2014/0097986 | A1 | 4/2014 | Xue et al. | |
| 2016/0226142 | A1 | 8/2016 | Leroux | |
| 2016/0308278 | A1 | 10/2016 | Luukanen | |
| 2016/0320684 | A1 | 11/2016 | Galstian | |
| 2017/0045652 | A1 | 2/2017 | Arbabi et al. | |
| 2017/0062948 | A1 | 3/2017 | Artemenko et al. | |
| 2017/0268988 | A1 | 9/2017 | Swanson | |
| 2017/0299500 | A1 | 10/2017 | Swanson | |
| 2017/0299697 | A1 | 10/2017 | Swanson | |
| 2019/0020124 | A1 * | 1/2019 | Song | H01Q 21/24 |
| 2021/0210870 | A1 * | 7/2021 | Tzadok | H01Q 21/22 |
| 2021/0376461 | A1 * | 12/2021 | Dallal | H01Q 3/2658 |
| 2022/0320729 | A1 * | 10/2022 | Cohen | H04B 1/18 |

FOREIGN PATENT DOCUMENTS

| | | | | |
|---|---|---|---|---|
| EP | 0 248 886 | B1 | 12/1991 | |
| EP | 1 496 372 | A1 | 1/2005 | |
| FR | 2 729 505 | B1 | 2/1997 | |
| GB | 1425142 | A | 2/1976 | |
| GB | 2250865 | B | 11/1992 | |
| GB | 2511845 | A | 9/2014 | |
| JP | 2000-114851 | A | 4/2000 | |
| JP | 2016-208229 | A | 12/2016 | |
| KR | 10-1605975 | B1 | 3/2016 | |
| KR | 101669775 | B1 * | 10/2016 | H01Q 3/36 |
| RU | 2 357 268 | C2 | 5/2009 | |
| RU | 2 688 949 | C1 | 5/2019 | |
| WO | 87/03746 | A1 | 6/1987 | |
| WO | 2015/105386 | A1 | 7/2015 | |

OTHER PUBLICATIONS

Jeffrey Grant Nicholls et al., "Full-Space Electronic Beam-Steering Transmitarray with Integrated Leaky-Wave Feed", IEEE Transactions on Antennas and Propagation, Aug. 2016, vol. 64, No. 8, pp. 3410-3422 (13 pages total).

Clemente, Antonio et al., "1 -Bit Reconfigurable Unit Cell Based on PIN Diodes for Transmit-Array Applications in X-Band", IEEE Transactions on Antennas and Propagation, May 2012, vol. 60, No. 5, pp. 2260-2269. (10 pages total).

Communication dated Mar. 27, 2019 by the Intellectual Property Office of Russia in counterpart Russian Patent Application No. 2018130706.

Communication dated Mar. 28, 2019 by the Intellectual Property Office of Russia in counterpart Russian Patent Application No. 2018130706.

International Search Report (PCT/ISA/210) and Written Opinion (PCT/ISA/237) dated Dec. 3, 2019 by the International Searching Authority in International Application No. PCT/KR2019/010840.

* cited by examiner

ANTENNA DEVICE FOR BEAM STEERING AND FOCUSING

TECHNICAL FIELD

The present disclosure relates to an antenna apparatus for beam steering and focusing.

BACKGROUND ART

Recently, as beam steering and beam focusing technologies are used in 5G communication, wireless power transfer (WPT) systems, and automotive radars, research into development of antennas having low loss, high gain, a small size, a wide steering angle, and a low price is being conducted. In particular, a simple and efficient antenna array technique is required in mmWave applications.

DESCRIPTION OF EMBODIMENTS

Technical Problem

According to an embodiment of the present disclosure, an efficient antenna apparatus for beam steering and focusing is provided.

Solution to Problem

According to an aspect of the present disclosure, provided is an antenna apparatus including: a signal splitter configured to generate a second signal including N equal-phase signals by splitting a first signal received from a signal source; a signal source virtual beam adjustor configured to generate a third signal including N signals by shifting a phase of each signal included in the second signal; a transmission beam adjustor configured to generate a fourth signal including N signals by shifting a phase of each signal included in the third signal by 0 degree or 180 degrees; and a transmitter including N transmission antennas respectively transmitting the N signals included in the fourth signal.

According to an embodiment, the signal splitter may include: a signal supplier transmitting the first signal; and a receiver including N reception antennas receiving the first signal from the signal supplier, wherein the first signal transmitted from the signal supplier is received at a same phase by the N reception antennas.

According to an embodiment, the N reception antennas may be arranged in a radiative near-field region of the signal supplier.

According to an embodiment, the N reception antennas may be arranged in a plane, and the signal supplier may include a waveguide configured to transmit the first signal to arrive at the N reception antennas as a plane wave.

According to an embodiment, the N reception antennas may be arranged in a plane at uniform distances, and the signal supplier may include N transmission antennas arranged in a plane at the uniform distances.

According to an embodiment, the N reception antennas may be arranged in a plane at uniform distances, and the signal supplier may include N transmission antennas arranged in a plane quasi-periodically to correspond to the uniform distances.

According to an embodiment, the N reception antennas may be slot antennas formed on a ground surface, and the signal source virtual beam adjustor may be coupled to the slot antennas via strip lines.

According to an embodiment, the signal source virtual beam adjustor may shift the phase of each signal included in the second signal so that the phase of each signal included in the third signal is equal to a phase of the first signal that would reach the N transmission antennas when the first signal is transmitted from one point.

According to an embodiment, the N transmission antennas may be arranged in a plane at uniform distances, and the signal source virtual beam adjustor may shift the phase of each signal included in the second signal so that the phase of each signal included in the third signal is equal to a phase of the first signal that would reach each of the N transmission antennas when the first signal is transmitted from a point that is away from a center of the plane by a certain distance in a direction perpendicular to the plane.

According to an embodiment, each value at which the signal source virtual beam adjustor shifts a phase of each signal included in the second signal may be a fixed value.

According to an embodiment, the signal source virtual beam adjustor may shift a phase of each signal included in the second signal by a fixed value via a delay line.

According to an embodiment, a length difference among delay lines with respect to the signals included in the second signal may be limited to be within a wavelength.

According to an embodiment, the transmission beam adjustor may determine a phase shift value of 0 degree or 180 degrees to be applied to each signal, according to a phase shift value of each signal for adjusting a transmission beam under an assumption that the signals included in the third signal have the same phase.

According to an embodiment, the transmission beam adjustor may determine a phase shift value of 0 degree or 180 degrees to be applied to each signal, according to a value obtained by adding a phase shift value of each signal in the signal source virtual beam adjustor to a phase shift value of each signal for adjusting a transmission beam under an assumption that the signals included in the third signal have the same phase.

According to an embodiment, the transmission beam adjustor may determine a phase shift value of 0 degree or 180 degrees to be applied to each signal, according to a value obtained by subtracting a phase shift value of each signal in the signal source virtual beam adjustor from a phase shift value of each signal for adjusting a transmission beam under an assumption that the signals included in the third signal have the same phase.

According to an embodiment, each of the N transmission antennas may be in the form of a rectangular patch having diagonally chamfered edges so that a transmission signal is circularly polarized.

According to an embodiment, the antenna apparatus may include a multi-layer substrate including three main layers, wherein a first main layer of the multi-layer substrate includes the transmitter including a patch antenna and the transmission beam adjustor including a switching element capable of changing a phase of a radiation signal of the patch antenna by 0 degree or 180 degrees, a second main layer under the first main layer of the multi-layer substrate includes the signal source virtual beam adjustor including a fixed phase shift section including a delay line, and a third main layer under the second main layer of the multi-layer substrate includes the receiver including a reception antenna array.

According to an embodiment, the antenna apparatus may include a multi-layer substrate including two main layers, wherein a first main layer of the multi-layer substrate includes the transmitter including a patch antenna and the transmission beam adjustor including a switching element capable of changing a phase of a radiation signal of the patch antenna by 0 degree or 180 degrees, a second main layer under the first main layer of the multi-layer substrate includes the signal source virtual beam adjustor including a fixed phase shift section including a delay line, and a ground layer under the second main layer of the multi-layer substrate includes the receiver including a slot antenna array.

According to an embodiment of the present disclosure, an antenna apparatus is provided, the antenna apparatus including: a receiver including N signal receivers; a signal source virtual beam adjustor configured to shift a phase of each of N signals received by the N signal receivers; a transmission beam adjustor configured to shift a phase of each of the N signals that are phase-shifted by the signal source virtual beam adjustor, by 0 degree or 180 degrees; and a transmitter including N transmission antennas respectively transmitting the N signals that are phase-shifted by the transmission beam adjustor.

According to an embodiment, when a same first signal is received by the N signal receivers, the signal source virtual beam adjustor may shift the phase of each of the N signals received by the N signal receivers so that the phase of each of the N signals that are phase-shifted by the signal source virtual beam adjustor is equal to a phase of the first signal that would reach each of the N transmission antennas arranged in a plane when the first signal is transmitted from one point.

An embodiment of the present disclosure includes a program stored in a computer-readable recording medium for executing a method according to an embodiment of the present disclosure on a computer.

An embodiment of the present disclosure includes a computer-readable recording medium having recorded thereon a program for executing a method according to an embodiment of the present disclosure on a computer.

Advantageous Effects of Disclosure

According to an embodiment of the present disclosure, an antenna apparatus that is simple, small-sized, low-priced, and efficient is provided.

MODE OF DISCLOSURE

Figure 1:
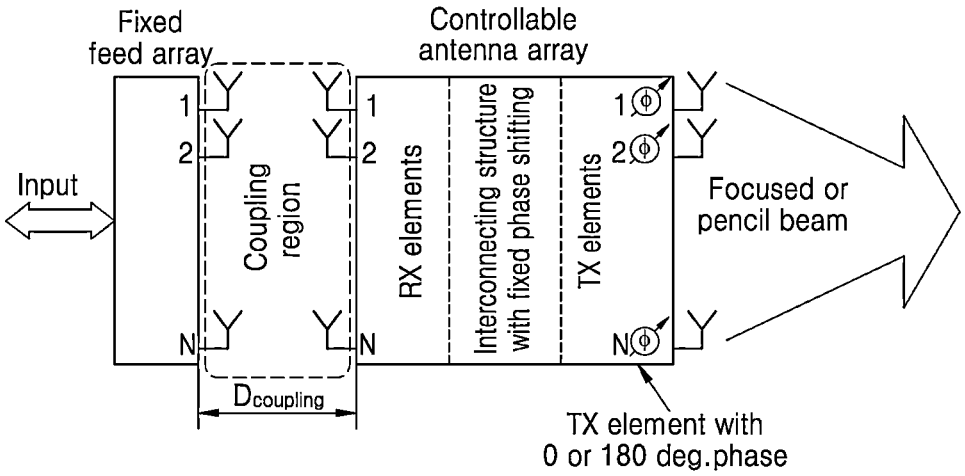
FIG. 1 illustrates a structure of an antenna apparatus according to an embodiment of the present disclosure.

In order to clarify the technical spirit of the present disclosure, an embodiment of the present disclosure will be described in detail with reference to the accompanying drawings. In the description of the present disclosure, certain detailed explanations of the related art or components are omitted when it is deemed that they may unnecessarily obscure the essence of the present disclosure. Components having substantially the same functional configuration in the drawings are labeled with the same reference numerals and symbols as much as possible even though they are shown in different drawings. For convenience of description, a device and method will be described together when necessary.

FIG. 1 illustrates a structure of an antenna apparatus according to an embodiment of the present disclosure. Referring to FIG. 1, the antenna apparatus according to an embodiment of the present disclosure may include a fixed feed array and a controllable antenna array (discrete control lens). The antenna apparatus may be used for transmission or reception, and below, the antenna apparatus being used for transmission will be described mainly for convenience. The lateral dimensions of the two antenna arrays may be essentially identical. At least in the interaction region, the apertures of the fixed array and controllable antenna array may be the same. The fixed feed array may receive energy through an input end and divide the received energy and supply the same to N antenna radiating elements to form radiating apertures. The fixed feed array needs to have low losses. To this end, the fixed feed array may be formed based on metallic waveguide structures. Radiating elements of the fixed feed array may be periodically arranged in front of corresponding receiving elements (RX elements) of the controllable antenna array. The radiating elements of the fixed feed array and the receiving elements of the controllable antenna array may be arranged in parallel with each other.

Thus, the fixed feed array may include a power dividing circuit with a plurality of outputs, where each output may excite a single radiating element or a group of radiating elements. The power dividing circuit may be based on metal waveguide structures. The fixed feed array may radiate waves with linear polarization. Any suitable antenna arrays can be used as the mentioned feed array, including, but not limited to, at least the following:

1) An array of opened rectangular waveguides having a power dividing circuit. In this case, the power dividing circuit may be of a two-dimensional structure in which an equal number of outputs to the number of aperture elements are implemented.

2) An array of slotted rectangular waveguides. In this case, a power dividing circuit may be of a one-dimensional structure in which an equal number of outputs to the number of slotted waveguides are implemented.

3) Slotted radial waveguide array. In this case, a power dividing circuit may be a multi-sectional radial waveguide in which slots are formed according to the shape of apertures of a fixed array 4) A slot array including a ridge gap waveguide power divider/coupler. In this case, the power divider/coupler may be of a 2D structure in which an equal number of outputs to the number of slots are implemented.

The controllable antenna array is used for beam steering or beam focusing. The controllable antenna array may have a multi-layer flat structure (multi-layer printed circuit board) including three main layers as below.

- a first main layer may include transmission elements (TX elements) that are periodically arranged and have a reconfigurable structure capable of phase shifting of radiating/receiving a signal between the values of 0 degree or 180 degrees. Here, 0 degrees and 180 degrees may be predefined arbitrary states of a TX element.
- A second main layer may include a coupling structure having a fixed phase shift, which couples TX elements and RX elements.
- A third main layer may include RX elements that are periodically arranged and receive radiation from radiating elements of the fixed feed array.

The periods (intervals) between the elements of the fixed feed array and the controllable antenna array may be the same and may be denoted as $D_x$, $D_y$ with respect to x- and y-axes. The periods may be selected according to a single beam steering condition as below.

$$D_{x,y} < \frac{\lambda}{1+\sin(\theta_S^{max})}$$

Here, $\lambda$ denotes a wavelength, and $\theta_S^{max}$ denotes a maximum beam steering angle.

$D_{x,y}$ may be $\geq\lambda/2$.

A distance between two arrays may be determined according to the following formula.

$$D_{coupling} < 2D_{array}^2/\lambda$$

Here, $D_{array}$ denotes a maximum length of a controllable antenna array.

Meanwhile, the distance between the arrays needs to be high enough so as to exclude the possibility that a reactive field of radiating elements of the fixed feed array are coupled to the controllable antenna array. That is, $D_{coupling}$ should be $>\lambda/4$. The above assumption indicates that the arrays are arranged in the Fresnel region, that is, in a radiative near-field region of the arrays.

The design of the RX elements of the controllable antenna array is optimized to receive a plane wave. That is, the RX elements of the controllable antenna array need to have a minimum reflection coefficient with respect to an incident plane wave. The TX elements of the controllable antenna array need to operate at a minimum reflection coefficient in a desired beam steering range. The controllable antenna array is a planar multi-layer printed circuit board (PCB) consisting of three main layers, between which there are ground layers.

An operation of a unit cell of a controllable antenna array in a TX mode, that is, when a signal is transmitted from the input end of the antenna to the controllable antenna array via the fixed feed array, will now be described with reference to FIGS. 2A through 2C.

Figure 2A:
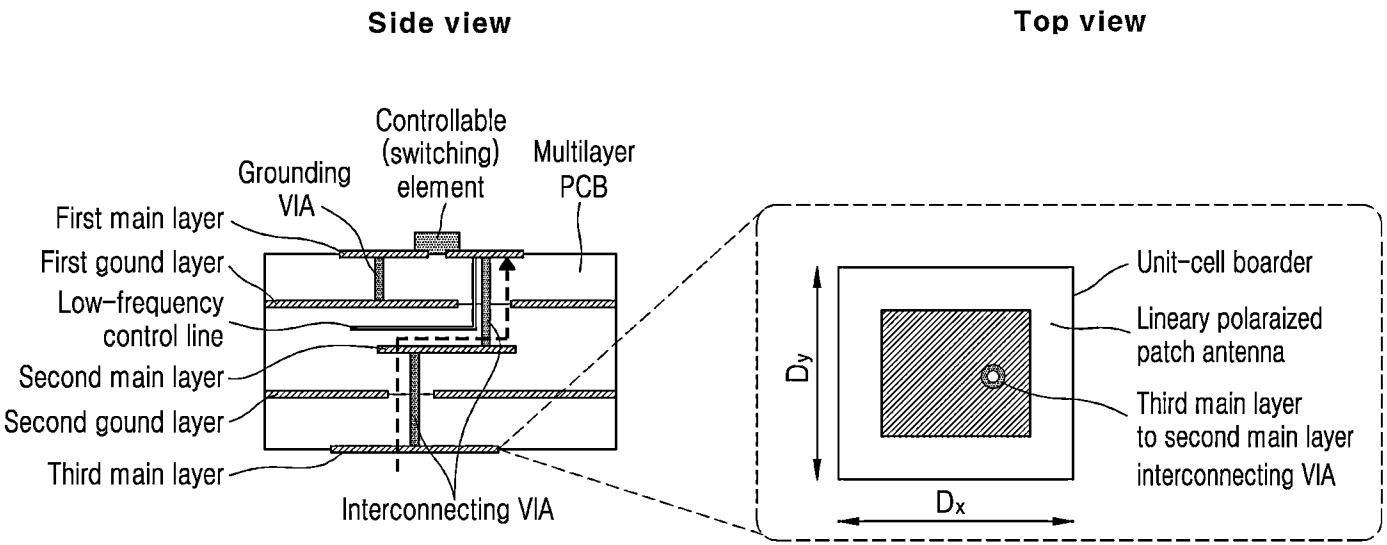
FIG. 2A illustrates a side view of a unit cell structure of a controllable antenna array and a plan view of a third main layer of a cell, according to an embodiment of the present disclosure.

FIG. 2A illustrates a side view (cross-sectional view) of a unit cell structure of a controllable antenna array and a plan view of a third main layer of a cell, according to an embodiment of the present disclosure. The third main layer of the cell may include a reception antenna element (RX element) in a rectangular patch antenna having linear polarization. According to another embodiment, an elliptical patch element may be used as a reception antenna element. The patch antenna may be connected to a second main layer via a plated VIA hole passing through a window of a second ground layer. The VIA hole may be manufactured according to the standard production technology of multi-layer printed circuit boards. The second ground layer may provide a shield for the patch antenna of the third main layer and a shield for a transmission line of the second main layer. An electromagnetic field radiated by elements of the fixed feed array may be received by RX elements of the controllable antenna array, and may be transferred to the second main layer for phase shifting and further transmission to TX elements.

According to another embodiment, connection between the patch antenna and the second main layer may be made through a slot aperture of the second ground layer. The slot aperture may be manufactured in a rectangular or dumbbell-shaped slot shape. In this case, a strip conductor orthogonal to a long side of the slot aperture may be connected to the patch antenna on the side of the second ground layer.

Figure 2B:
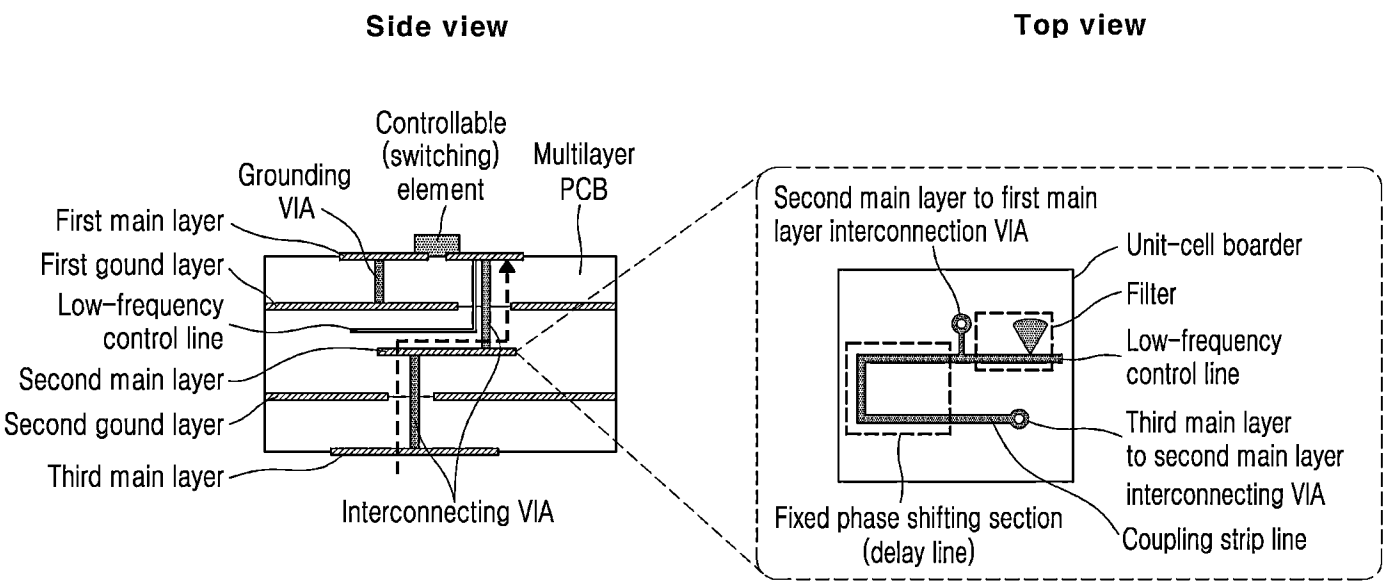
FIG. 2B illustrates a side view of a unit cell structure of a controllable antenna array and a plan view of a second main layer of a cell, according to an embodiment of the present disclosure.

FIG. 2B illustrates a side view (cross-sectional view) of a unit cell structure of a controllable antenna array and a plan view of the second main layer of a cell, according to an embodiment of the present disclosure. An electromagnetic signal may enter a strip communication line of the second main layer through a VIA connected from the third main layer to the second main layer. The signal then may pass through a fixed phase shift section formed in the form of a delay line (transmission line) having a length $L_{PS}$. Each unit cell of the controllable antenna array may have a transmission line having its own unique $L_{PS}$ that is calculated according to the principle to be described later. In addition, a mmWave electromagnetic signal may pass through a window of a first ground layer through a VIA connected from the second main layer to a first main layer to be supplied to a TX element. At the same time, a low-frequency control signal may be applied to the TX element from a low-frequency control line through the VIA connected from the second main layer to the first main layer. To decouple the low-frequency control signal and the mmWave signal, a band-stop filter may be used to prevent the mm-wave signal from reaching the low-frequency control signal. This may be a filter formed of a parallel-connected ¼ wave open segment of a transmission line or a parallel-connected radial line segment (shown in the drawing) that is embedded between the low-frequency control line and the VIA connected from the second main layer to the first main layer. The low-frequency control signal may be a DC signal.

Figure 2C:
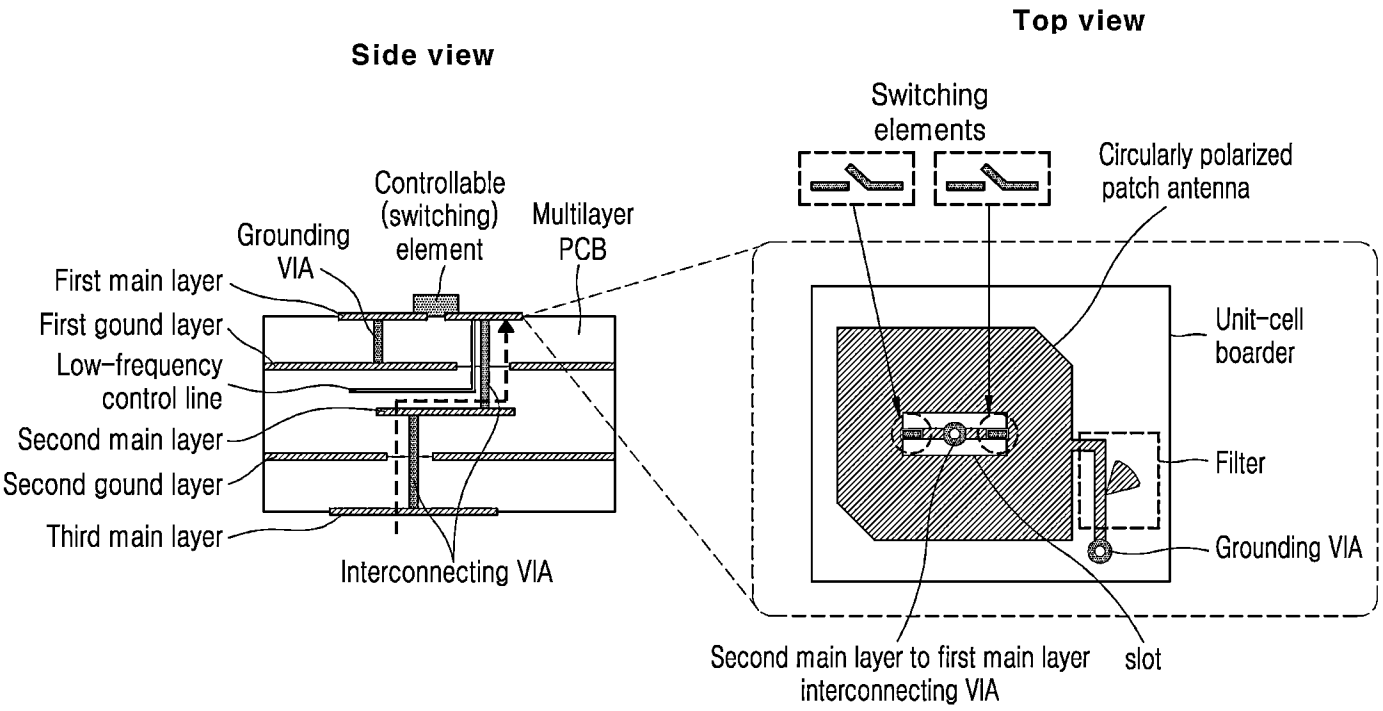
FIG. 2C illustrates a side view of a unit cell structure of a controllable antenna array and a plan view of a first main layer of a cell, according to an embodiment of the present disclosure.

FIG. 2C illustrates a side view (cross-sectional view) of a unit cell structure of a controllable antenna array and a plan view of the first main layer of a cell, according to an embodiment of the present disclosure. The first main layer may include a TX element in the form of a rectangular patch antenna having diagonally chamfered edges to excite radiation by circular polarization. A slot may be formed in the patch-antenna, and in the slot, a VIA may come from the second main layer to the first main layer. The patch antenna may be excited by connecting the main portion of the patch antenna to the VIA from the second main layer to the first main layer, by using a controllable switching element. The switching elements have the same orientation, as illustrated in FIG. 2C, and when a control voltage is applied to the VIA connected from the second main layer to the first main layer, only one of the two switching elements closes, and the other switching element remains open. In this case, the TX element forms a circularly polarized radiation at a phase of 0 degree or 180 degrees. When the control voltage changes its polarity to the opposite, then the closed switching element opens, while the open switching element closes.

Here, the excitation current changes its direction, and accordingly, the phase of the radiation field of the TX element is reversed. The structure of the patch antenna may be grounded via a grounding VIA connected by a millimeter-wave band-stop filter. The above-described grounding is required to realize low-frequency control of switching elements. As a control electric potential is supplied to a structure-centered controllable element via the VIA connected from the second main layer to the first main layer, grounding may be designed to provide zero potential on the surface of the patch antenna. In this embodiment, the low-frequency control signal needs to be bipolar (for example, ±1V). That is, when a signal is supplied, one of the elements is closed, and the other element is closed, and when the polarity of the signal changes, the opposite occurs.

Accordingly, 1-bit (0, 180 degrees) phase control of radiation of a controllable antenna array cell is realized. The antenna according to an embodiment of the present disclosure has compact sizes, low losses, and simple architecture. In the unit cell structure as described above, a PIN diode, a MEMS switch, a photoconductive switch, or the like may be used as a switching element.

In an RX mode, the above-described antenna operates as follows. A signal is transferred from free space to the TX elements of the controllable array, to the fixed array elements through the interaction region, and to the output end of the fixed array connected to the receiver through a fixed array split system.

A beam steering/focusing method according to a method of controlling a phase of a TX element according to the related art will now be described with reference to FIG. 3.

A plane wave from a fixed feed array (not shown) reaches the controllable antenna array. In the present embodiment, there is no fixed phase shift in the controllable antenna array. The controllable antenna array is excited by a plane wave from a fixed feed array, and thus, radiation received by all RX elements of the controllable antenna array have an identical phase. In this case, to adjust a focus of radiation at a certain point M, the following phase shift of an ith TX element needs to be implemented.

$$\Delta\varphi_i = \frac{2\pi}{\lambda} R_i$$

Here, $R_i=\sqrt{(x-x_i)^2+(y-y_i)^2+z^2}$, where $R_i$ denotes a distance between an ith element having coordinates ($x_i$, $y_i$, 0) and a focal point M having coordinates (x, y, z).

$\Delta\varphi_i$ may be converted into two states to determine a controllable state of a TX element. For example, by removing an integer multiple of $2\pi$ from $\Delta\varphi_i$, a controllable state of the TX element may be determined according to a following relation.

$$\text{State}_i = \begin{cases} 0 \text{ degrees, if } 0 \le \Delta\varphi_{0i} < 180 \text{ degrees} \\ 180 \text{ degrees, if } 180 \le \Delta\varphi_{0i} < 360 \text{ degrees} \end{cases}$$

Here, $\Delta\Phi_{0i}=\Delta\varphi_i \bmod 2\pi$.

a mod b denotes operation for finding the remainder of the division, a is a dividend, and b is a divisor.

When steering radiation in direction ($\theta_S$,$\varphi_S$), phase shift of the ith TX element may be determined based on the following equation.

$$\Delta\varphi_i = -\frac{2\pi}{\lambda}(x_i\sin(\theta_S)\cos(\varphi_S) + y_i\sin(\theta_S)\sin(\varphi_S))$$

Here, $\theta_S$, $\varphi_S$ respectively denote an elevation angle and an azimuth angle of a required beam steering direction.

By using the above-described steering/focusing method, parasitic "mirror" effects are generated. This indicates that a specular beam or focal point is formed in addition to the main beam or the focal point.

Figure 3:
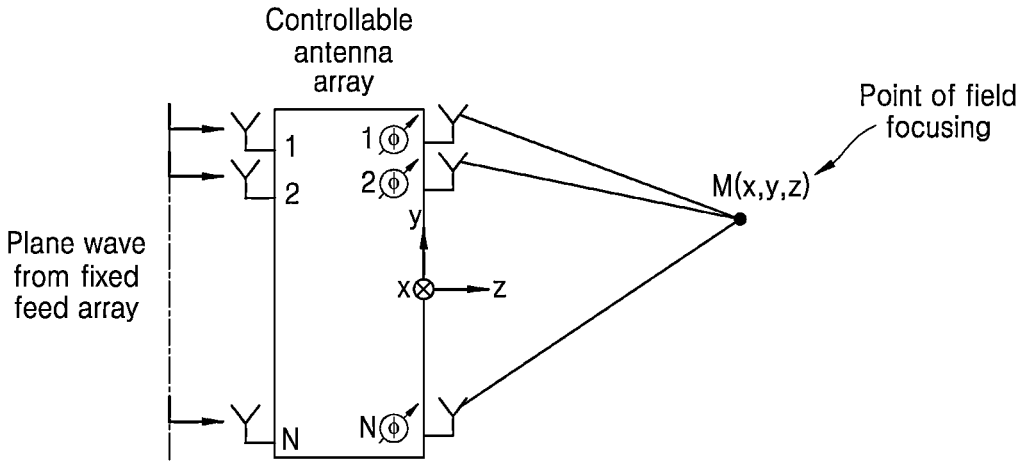
FIG. 3 illustrates a beam steering/focusing method according to a method of controlling a phase of a TX element, according to the related art.
Figure 4:
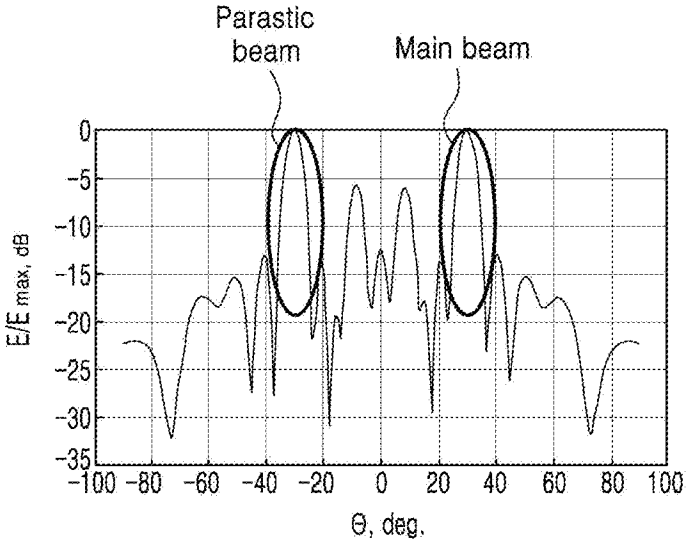
FIG. 4 illustrates an example of a simulation of the beam steering/focusing method of FIG. 3.
Figure 4:
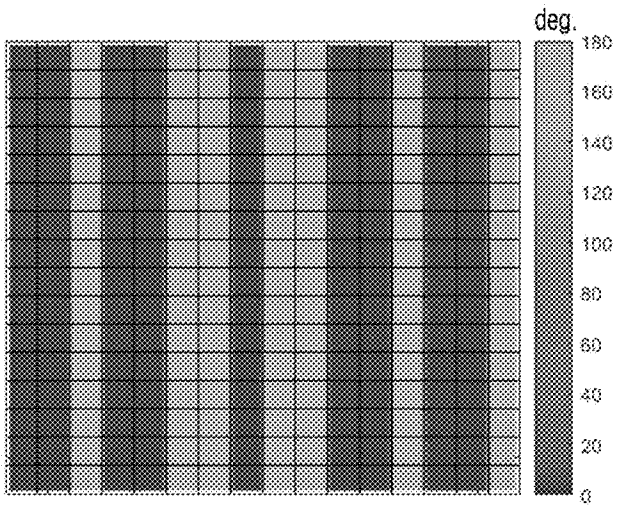

FIG. 4 illustrates an example of simulation of the beam steering/focusing method of FIG. 3. In an exemplary embodiment, there is an array of TX elements (16×16) having $D_{x,y}=0.6\lambda$, and a beam is to be steered in a direction of coordinates $\theta_S=30$ degrees and $\varphi_S=0$.

The left part of FIG. 4 illustrates a result of phase distribution (0, 180 degrees) with respect to the 16×16 array of the TX elements. The right part of FIG. 4 illustrates a calculated radiation pattern of the array in the cross-section of $\varphi=0$. As indicated by the radiation pattern, by using the method of controlling a phase of the TX elements according to FIG. 3, a parasitic mirror beam is formed. The parasitic mirror beam may be highly disadvantageous since the presence of the parasitic mirror beam causes loss of an energy amount equal to that of a main beam and thus decreases the efficiency of a wireless system when using a mmWave antenna array. This is the major disadvantage when directly applying the Fresnel's lens principle to steering lens arrays.

A steering/focusing method based on a virtual focus according to an embodiment of the present disclosure will now be described with reference to FIG. 5. According to an embodiment of the present disclosure, a fixed phase shift of each unit cell of a controllable antenna array is proposed. To compensate a mirror effect, it is assumed that a controllable antenna array is irradiated with a spherical wave from a virtual focus (virtual point radiator), the virtual focus having coordinates (0, 0, −F). A real controllable antenna array is irradiated with a plane wave from the fixed feed array. To introduce the effect of a virtual focus (simulation), a phase shift of each unit cell of the controllable antenna array may be added using a fixed phase shift section in the second main layer of the cell. Each fixed phase shift section needs to have a phase shift as below.

$$\Delta\varphi_{VFi} = \frac{2\pi}{\lambda}\left[\sqrt{x_i^2 + y_i^2 + F^2} - F\right]$$

Accordingly, a length increment $\Delta L_{PSi}$ of a delay line of an ith unit cell with respect to a length $L_{PS\ min}$ of a delay line of a unit cell having a minimum phase shift of the controllable antenna array may be calculated according to the following formula.

$$\Delta L_{PSi} = \frac{\Delta\varphi_{VFi} - \min(\Delta\varphi_{VFi})}{\beta_{PS}}$$

Here, the phase shift $\min(\Delta\varphi_{VFi})$ corresponds to a phase shift of a unit cell having a minimum phase shift of the controllable antenna array, and $\beta_{PS}$ is a propagation constant of the fixed phase shift section.

$$L_{PS\ min} = \frac{\min(\Delta\varphi_{VFi})}{\beta_{PS}}.$$

The unit cell having a minimum phase shift may be a unit cell in a center of the controllable antenna array.

$L_{PS\ min}$ may be formed to constitute a particular tracking configuration of a mmWave signal transmission line of the second main layer of the controllable antenna array. $L_{PS\ min}$ may be a minimum length of a transmission line between two VIAS connecting the second main layer to the first main layer and the third main layer.

Accordingly, a length of the fixed phase shift section of the ith unit cell may be calculated as follows.

$$L_{PSI}=L_{PS\ min}+\Delta L_{PSi}$$

To implement beam focusing/steering, a total phase shift of each ith cell may be considered.

$$\Delta\varphi_{FULLi}=\Delta\varphi_i+\Delta\varphi_{VFi},$$

Here, $\Delta\varphi_i$ may be calculated according to the above-described formula with respect to beam focusing and steering.

A state of a TX element may be determined according to the above-described formula.

A final phase distribution with respect to all TX elements of the controllable antenna array may be obtained according to the following formula.

$$\Delta\varphi_{FULLi}=\text{State}_i+\Delta\varphi_{VFi},$$

In an embodiment, $\Delta\varphi_{FULLi}$ may be converted into two states to determine the controllable state of the TX elements. For example, the state of the TX elements may be determined using $\Delta\varphi_{FULLi}$ instead of $\Delta\varphi_i$ in the above-described formula. That is, by removing an integer multiple of $2\pi$ from $\Delta\varphi_{FULLi}$, the controllable states of the TX elements may be determined according to a following relation.

$$\text{State}_i = \begin{cases} 0 \text{ degrees, if } 0 \le \Delta\varphi_{0FULLi} < 180 \text{ degrees} \\ 180 \text{ degrees, if } 180 \le \Delta\varphi_{0FULLi} < 360 \text{ degrees} \end{cases}$$

Here, $\Delta\varphi_{0FULLi}=\Delta\varphi_{FULLi} \bmod 2\pi$.

The final phase distribution with respect to all TX elements of the controllable antenna array may be obtained according to the following formula.

$$\Delta\varphi_{FULLi}=\text{State}_i+\Delta\varphi_{VFi},$$

According to another embodiment, to implement beam focusing/steering, a compensation phase shift of each ith cell may be considered.

$$\Delta\varphi_{COMPi}=\Delta\varphi_i-\Delta\varphi_{VFi},$$

Here, $\Delta\varphi_i$ may be calculated according to the above-described formula with respect to beam focusing and steering.

Finally, $\Delta\varphi_{COMPi}$ may be converted into two states to determine the controllable states of the TX elements. For example, the states of the TX elements may be determined using $\Delta\varphi_{COMPi}$ instead of $\Delta\varphi_i$ in the above-described formula. That is, by removing an integer multiple of $2\pi$ from $\Delta\varphi_{COMPi}$, the controllable states of the TX elements may be determined according to a following relation.

$$\text{State}_i = \begin{cases} 0 \text{ degrees, if } 0 \le \Delta\varphi_{0COMPi} < 180 \text{ degrees} \\ 180 \text{ degrees, if } 180 \le \Delta\varphi_{0COMPi} < 360 \text{ degrees} \end{cases}$$

Here, $\Delta\varphi_{0COMPi}=\Delta\varphi_{COMPi} \bmod 2\pi$.

The final phase distribution with respect to all TX elements of the controllable antenna array may be obtained according to the following formula.

$$\Delta\Phi_{FULLi}=\text{State}_i+\Delta\varphi_{VFi},$$

Figure 5:
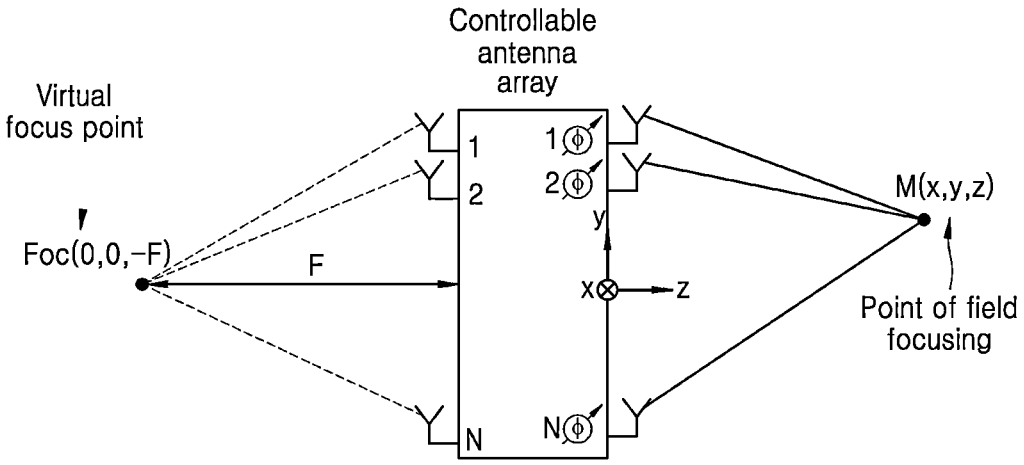
FIG. 5 illustrates a steering/focusing method based on a virtual focus, according to an embodiment of the present disclosure.
Figure 6:
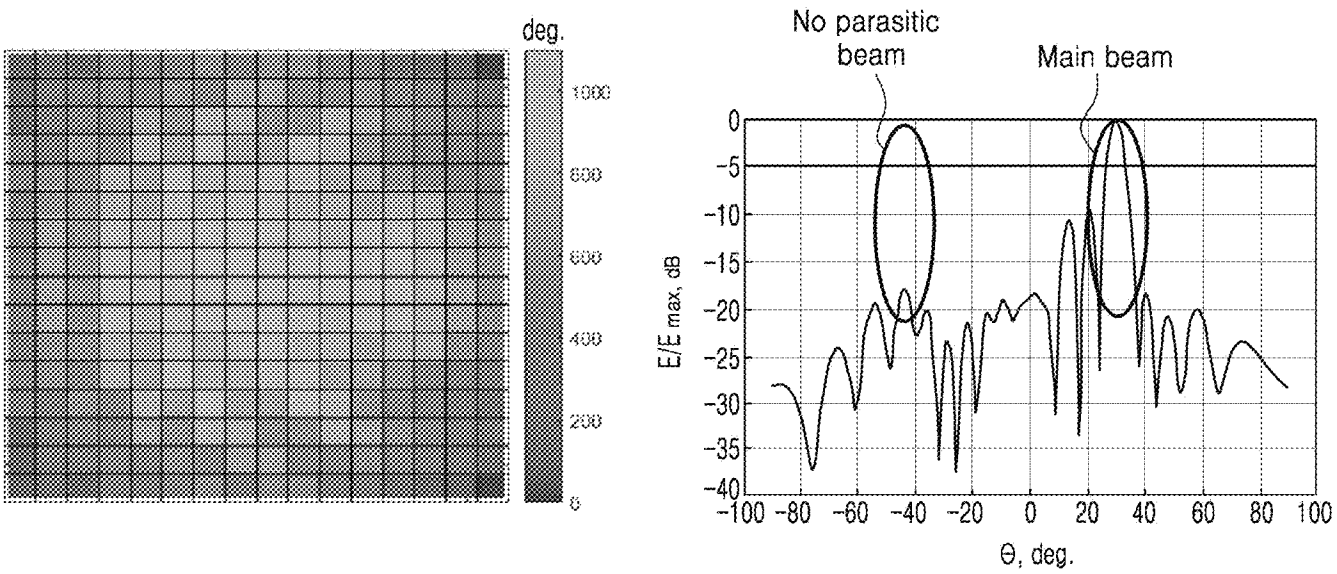
FIG. 6 illustrates an example of a simulation of the beam steering/focusing method of FIG. 5.

FIG. 6 illustrates an example of simulation of the beam steering/focusing method of FIG. 5. In an exemplary embodiment, there is an array of TX elements (16×16) having $D_{x,y}=0.6\lambda$, and a beam is to be steered in a direction of coordinates $\theta_S=30$ degrees and $\varphi_S=0$. A position of a virtual focus is $F=6\lambda$.

The left part of FIG. 6 illustrates a phase distribution obtained with respect to the 16×16 array of the TX elements. The right part of FIG. 6 illustrates a calculated radiation pattern. As indicated by the radiation pattern, by using the method of controlling a phase of a TX element of the present disclosure, no parasitic beam is formed. Thus, according to the present embodiment, loss is considerably lower than in the embodiment of FIG. 4.

According to the antenna of the present disclosure, both beam steering and beam focusing are possible. In this case, by using a virtual focus, which results in characteristics of a direction pattern that are similar to that of a lens array with a radiator at a real focus that is away from a controllable lens array plane by a certain distance, the mirror effect may be removed. The actual focal distance is typically similar to a horizontal dimension of an array. An overall size of the antenna according to the present disclosure has a significantly smaller size than a structure according to the related art.

The antenna controlling method according to the present disclosure may be implemented using a processing apparatus executing program codes recorded to a computer-readable medium.

Hereinafter, alternative embodiments of the present disclosure will be described.

Figure 7:
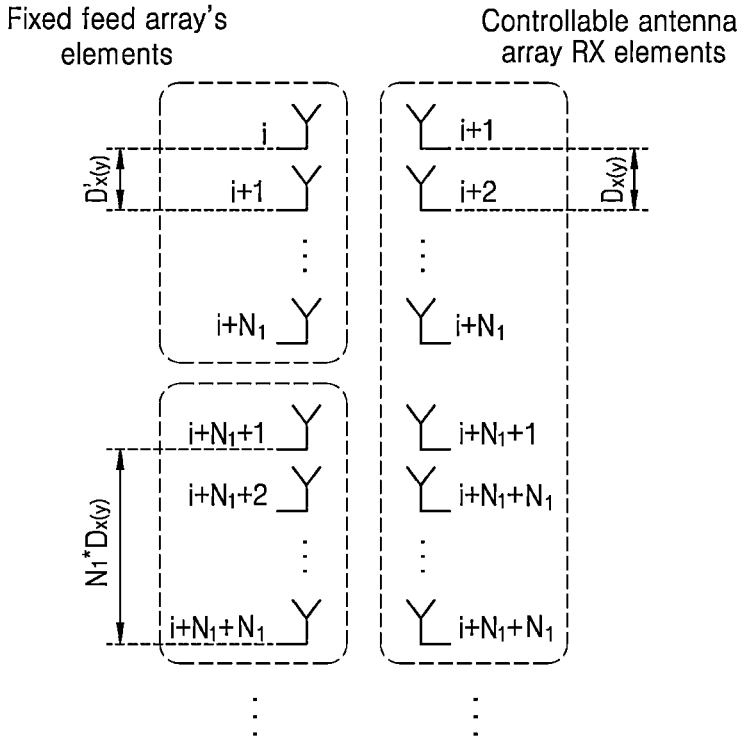
FIG. 7 illustrates a quasi-periodic structure of a fixed feed array according to an alternative embodiment of the present disclosure.

According to an alternative embodiment of the present disclosure illustrated in FIG. 7, a fixed feed array may have a quasi-periodic structure based on the technological requirements. That is, radiating elements of the fixed feed array may be quasi-periodically arranged along x and y axes. The arrangement of the elements may be preferable in respect of engineering considerations related to wiring of the excitation channels of the fixed array elements. In this case, the RX elements and the TX elements of a controllable antenna array may be periodically arranged. The elements of the fixed feed array may be grouped into, for example, groups of N1 elements, and a distance between the elements of the fixed feed array in the group on the x and y axes is not equal to a distance between the elements of the controllable antenna array, and thus, $D'_{x(y)} \neq D_{x(y)}$. However, the groups of the elements of the fixed feed array may be periodically arranged with a period of $N_1 * D_{x(y)}$. The area of the antenna may be increased according to the above arrangement.

Figure 8:
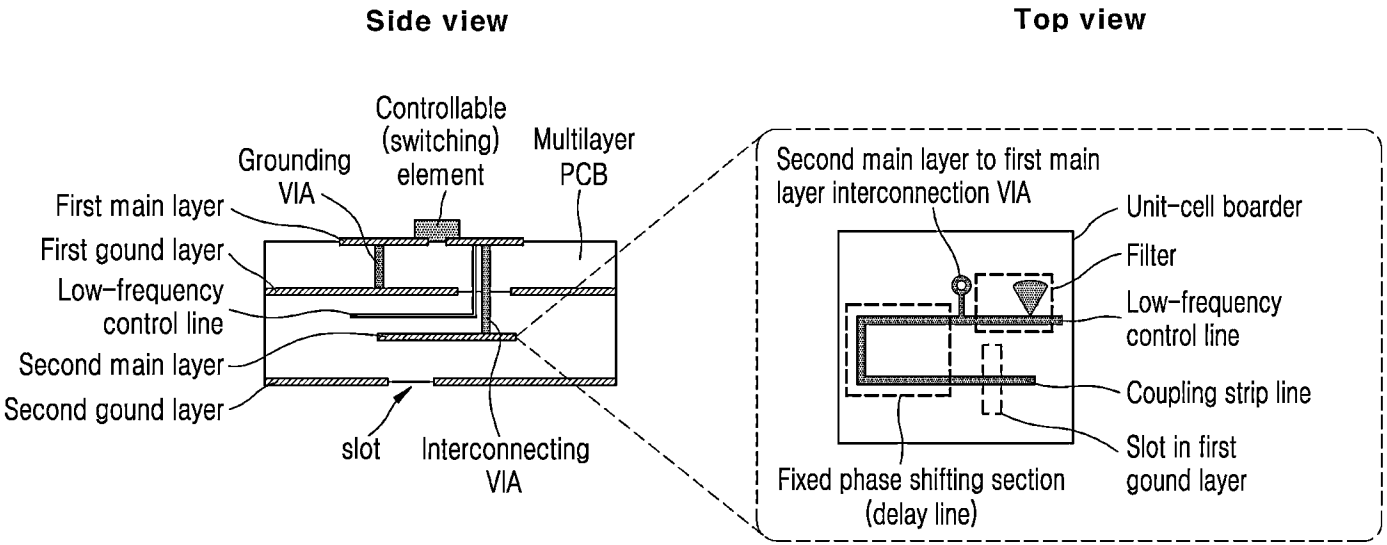
FIG. 8 illustrates a side view (cross-sectional view) of a unit cell structure of a controllable antenna array and a plan view of a second main layer of a cell, according to an alternative embodiment of the present disclosure.

In an alternative embodiment of a unit cell structure of an antenna array illustrated in FIG. 8, compared to the embodiment of FIGS. 2A through 2C, there is no third main layer having a receiving patch antenna. In this embodiment, an excitation signal enters through a slot of a second ground layer (slot antenna), and is received by a strip line link of a second main layer through electromagnetic coupling. In the present embodiment, the second ground layer forms a conductive element of the slot antenna and also shielding with respect to a transmission line of the second main layer. A unit cell of a controllable antenna array according to the present embodiment operates in a similar manner to the embodiments of FIGS. 2B and 2C. According to the present embodiment, a simpler cell structure of a controllable antenna array is provided. The above embodiment has a narrower bandwidth of matching the slot RX element of the controllable antenna array compared to the patch element of the controllable antenna array.

Figure 9:
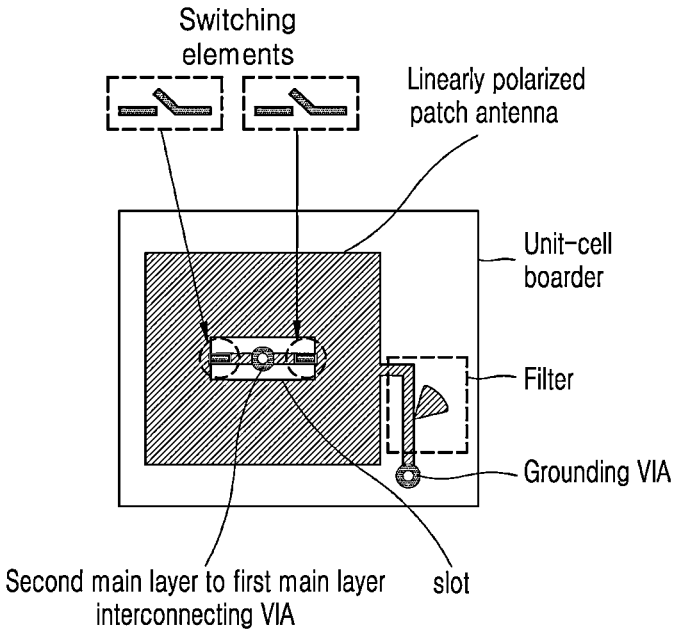
FIG. 9 illustrates an alternative embodiment of a patch antenna of a first main layer of a unit cell of a controllable antenna array.

FIG. 9 illustrates an alternative embodiment of a patch antenna of a first main layer of a unit cell of a controllable antenna array. In the alternative embodiment of the present disclosure illustrated in FIG. 9, a rectangular patch antenna that is linearly polarized may be used as a TX element of a first main layer of the unit cell of the controllable antenna array. The above embodiment may be useful in linear polarization communication systems.

According to another alternative embodiment, a phase shift provided by a fixed phase shift section of each cell of the controllable antenna array may be reduced by an integer multiple of $2\pi$ radian as below:

$$\Delta\varphi_{VFi} = \left(\frac{2\pi}{\lambda}\left[\sqrt{x_i^2 + y_i^2 + F^2} - F\right]\right) \bmod 2\pi$$

This may reduce a required length of the fixed phase shift section of the cell of the controllable antenna array, thereby reducing loss in an antenna array and the magnitude of the loss.

While the antenna according to the present disclosure may be used in a millimeter wavelength range, alternatively, an arbitrary wavelength range in which radiation of electromagnetic waves and controlled steering/focusing are possible may be used. For example, a short wave, a submillimeter (terahertz) radiation, or the like may be used.

The steering antenna array system according to the present disclosure, which has a small size and is very effective, may be used in enhanced wireless communication systems of 5G and WiGig standards. In this case, the present disclosure may apply both to antennas of base stations and terminals. In this case, base stations may implement beam steering by time division among users. An antenna of a user terminal may be steered to a location of a base station.

The present disclosure may apply to all types of LWPT systems, that is, outdoor/indoor, automotive, mobile systems, etc. In any scenario, high power transmission efficiency is ensured. A power transfer device may be established using the above-described antenna array structure, and thus, beam focusing on a device being charged in a near-field region or beam steering for transmitting power to a device located in a far field may be implemented.

When used in robotics, the proposed antenna may be used to detect/avoid obstacles. The present disclosure may also apply to automotive radars.

Figure 10:
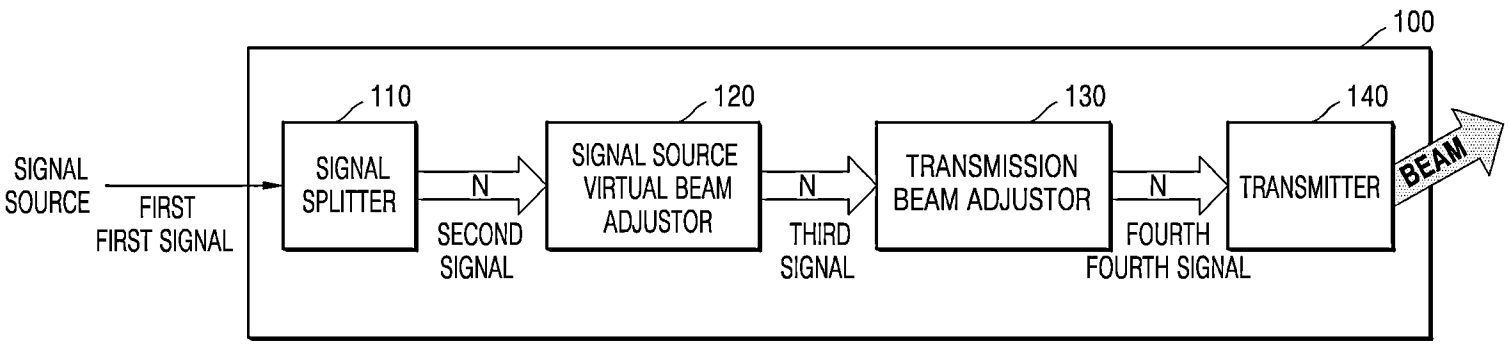
FIG. 10 is a schematic block diagram illustrating a structure of an antenna apparatus according to an embodiment of the present disclosure.

FIG. 10 is a schematic block diagram illustrating a structure of an antenna apparatus according to an embodiment of the present disclosure. Referring to FIG. 10, an antenna apparatus 100 according to an embodiment of the present disclosure may include a signal splitter 110, a signal source virtual beam adjustor 120, a transmission beam adjustor 130, and a transmitter 140. The signal splitter 110 may generate a second signal including N equal-phase signals by splitting a first signal received from a signal source. The second signal is a set of signals including a plurality of signals. Here, splitting of a signal may be splitting of power of the signal. The signal splitter may be a typical, wired power splitter or may also split a signal into N signals by using an antenna array as described above.

The signal source virtual beam adjustor 120 may generate a third signal including N signals, by shifting a phase of each signal included in the second signal. The third signal is a set of signals including a plurality of signals. By differently shifting the phases of the equal-phase signals that are generated by splitting a signal received from a signal source, the signal source virtual beam adjustor 120 may produce the effect as if a beam of a particular shape is radiated from the signal source.

The signal source virtual beam adjustor 120 may shift the phase of each signal included in the second signal so that the phase of each signal included in the third signal is equal to a phase of the first signal that would reach each of the N transmission antennas of the transmitter 140 if the first signal was transmitted from one point. The N transmission antennas of the transmitter 140 may be arranged in a plane. The N transmission antennas of the transmitter 140 may be arranged in a plane at uniform distances. The signal source virtual beam adjustor 120 may shift the phase of each signal included in the second signal so that the phase of each signal included in the third signal is equal to a phase of the first signal that would reach each of the N transmission antennas of the transmitter 140 that are arranged in a plane at uniform distances when the first signal is transmitted from one point.

The N transmission antennas of the transmitter 140 may be arranged in a plane at uniform distances, and the signal source virtual beam adjustor 120 may shift the phase of each signal included in the second signal so that the phase of each signal included in the third signal is equal to a phase of the first signal that would reach each of the N transmission antennas of the transmitter 140 when the first signal is transmitted from a point that is away from a center of the plane by a uniform distance in a direction perpendicular to the plane.

Each value at which the signal source virtual beam adjustor 120 shifts a phase of each signal included in the second signal may be a fixed value. The signal source virtual beam adjustor 120 may shift a phase of each signal included in the second signal by a fixed value via a delay line. A length difference among delay lines with respect to the signals included in the second signal may be greater than a wavelength, but in this case, by reducing the length of the delay line by an integer multiple of the wavelength, the length difference between the delay lines may be limited to be within the wavelength. The signal source virtual beam adjustor 120 may include a fixed phase shift section of the second main layer described above.

The transmission beam adjustor 130 may generate a fourth signal including N signals by shifting a phase of each signal included in the third signal by 0 degree or 180 degrees, and the transmitter 140 may include N transmission antennas transmitting each signal included in the fourth signal. That is, the transmission beam adjustor 130 may shift a phase of signals transmitted via the N transmission antennas of the transmitter 140 to perform beam steering or beam focusing.

The transmission beam adjustor 130 may determine a phase shift value of 0 degree or 180 degrees to be applied to each signal, according to a phase shift value of each signal for adjusting a transmission beam under the assumption that signals included in the third signal have the same phase. Here, adjustment of a transmission beam may include beam steering or beam focusing. The transmission beam adjustor 130 may determine a phase shift value of 0 degree or 180 degrees to be applied to each signal, according to a value obtained by adding a phase shift value of each signal in the signal source virtual beam adjustor 120 to a phase shift value of each signal for adjusting a transmission beam under the assumption that the signals included in the third signal have the same phase. The transmission beam adjustor 130 may determine a phase shift value of 0 degree or 180 degrees to be applied to each signal, according to a value obtained by subtracting a phase shift value of each signal in the signal source virtual beam adjustor 120 from a phase shift value of each signal for adjusting a transmission beam under the assumption that the signals included in the third signal have the same phase.

Each of the N transmission antennas of the transmitter 140 may be in the form of a rectangular patch having diagonally chamfered edges so that a transmission signal is circularly polarized. Only two opposite edges of the rectangular patch may be diagonally chamfered. Circular polarization may be a concept including not only full circular polarization but also oval polarization. The transmission beam adjustor 130 may include a switching element of the first main layer described above, and the transmitter 140 may include a patch antenna of the first main layer described above.

Each phase shift value of the signal source virtual beam adjustor 120 is a fixed value, and a phase shift value of the transmission beam adjustor 130 include two values of 0 degrees and 180 degrees, and thus, the antenna apparatus according to the present disclosure does not require an expensive phase shift device, and beam adjustment may be performed using a 1-bit signal for each cell.

Figure 11:
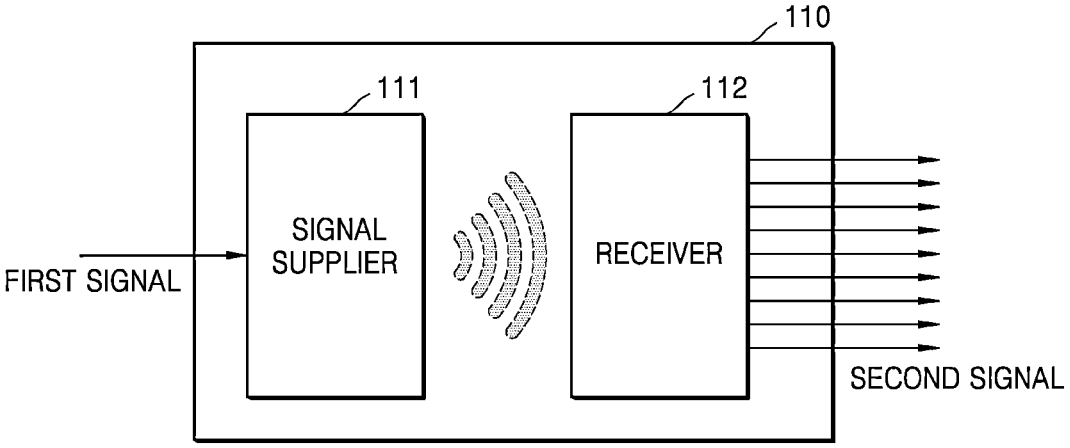
FIG. 11 is a schematic block diagram of a structure of a signal splitter according to an embodiment of the present disclosure.

FIG. 11 is a schematic block diagram of a structure of a signal splitter according to an embodiment of the present disclosure. Referring to FIG. 11, the signal splitter 110 may include a signal supplier 111 and a receiver 112. The signal supplier 111 may transmit a first signal to the receiver 112. The receiver 112 may receive the first signal to output a second signal including N equal-phase signals.

The receiver 112 may include N signal receivers. A signal receiver may be an antenna receiving the first signal from the signal supplier 111. The receiver 112 includes N reception antennas receiving the first signal from the signal supplier 111, and the first signal transmitted from the signal supplier 111 may be received by N reception antennas at a same phase. The N reception antennas of the receiver 112 may be arranged in a radiative near-field region of the signal supplier 111, that is, in a Fresnel region. The N reception antennas of the receiver 112 may be arranged in a plane, and the signal supplier 111 may include a waveguide configured to transmit the first signal to arrive at the N reception antennas as a plane wave. The arrangement of antennas in a plane may include arrangement of the antennas in a straight line.

The N reception antennas of the receiver 112 may be arranged in a plane at uniform distances. The signal supplier 111 may include N transmission antennas that are arranged in a plane at the same uniform distances as those at which the N reception antennas of the receiver 112 are arranged. Here, the uniform distances may mean that distances in an x-axis direction and distances in a y-axis direction are respectively uniform. A plane in which the N reception antennas of the receiver 112 are arranged may be parallel to a plane in which the N transmission antennas of the signal supplier 111 are arranged. The signal supplier 111 may include N transmission antennas that are arranged in a plane quasi-periodically to correspond to the distances at which the N reception antennas are arranged.

Each of the N reception antennas of the receiver 112 may be a slot antenna formed on a ground surface, and the signal source virtual beam adjustor 120 may be coupled to the slot antennas via strip lines. The strip line of the signal source virtual beam adjustor 120 may be orthogonal to a long side of apertures of the slot antenna.

The signal supplier 111 may include a radiating element of the fixed feed array described above, and the receiver 112 may include the receiving element of the third main layer described above. The receiver 112 may include a slot antenna of the second ground layer described with reference to FIG. 8.

Figure 12:
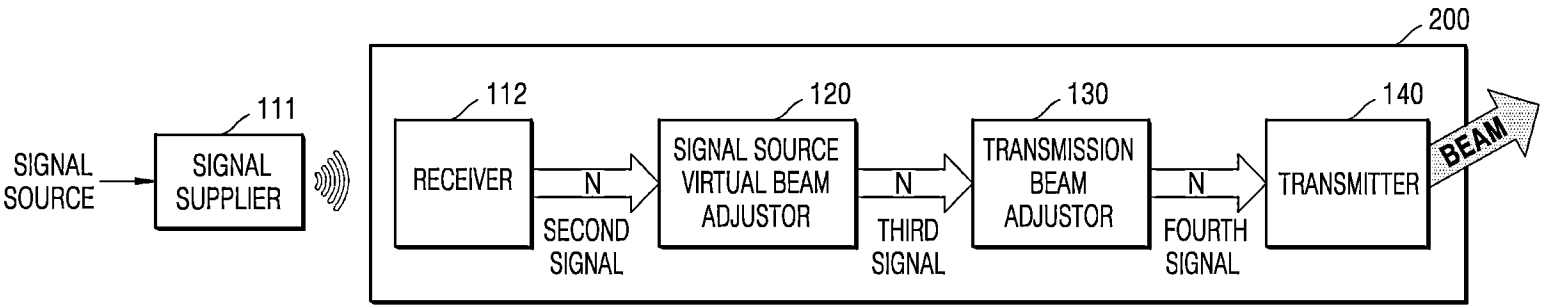
FIG. 12 is a block diagram illustrating a detailed structure of the signal splitter illustrated in FIG. 11 together with the structure of the antenna apparatus illustrated in FIG. 10.

FIG. 12 is a block diagram illustrating a detailed structure of the signal splitter illustrated in FIG. 11 together with the structure of the antenna apparatus illustrated in FIG. 10. Referring to FIG. 12, an antenna apparatus 200 according to an embodiment of the present disclosure may be a lens apparatus, from which the signal supplier 111 is excluded. That is, the antenna apparatus 200 according to an embodiment of the present disclosure may include a receiver 112 including N signal receivers, a signal source virtual beam adjustor 120 shifting a phase of each of N signals received by the N signal receivers, a transmission beam adjustor 130 shifting, by 0 degree or 180 degrees, the phase of each of the N signals that are phase-shifted by the signal source virtual beam adjustor 120, and a transmitter 140 including N transmission antennas respectively transmitting the N signals that are phase-shifted by the transmission beam adjustor 130. The antenna apparatus 200 may include the above-described controllable antenna array.

When a same first signal is received by the N signal receivers, the signal source virtual beam adjustor 120 may shift the phase of each of the N signals received by the N signal receivers so that the phase of each of the N signals that are phase-shifted by the signal source virtual beam adjustor 120 is equal to a phase of the first signal that would reach each of the N transmission antennas that are arranged in a plane when the first signal is transmitted from one point.

The signal source virtual beam adjustor 120 may shift the phase of each signal included in the second signal so that the phase of each signal included in the third signal is equal to a phase of the first signal that would reach each of the N reception antennas of the receiver 112 that are arranged in a plane at uniform distances when the first signal is transmitted from one point. The N reception antennas of the receiver 112 may be arranged in a plane at uniform distances, and the signal source virtual beam adjustor 120 may shift the phase of each signal included in the second signal so that the phase of each signal included in the third signal is equal to a phase of the first signal that would reach each of the N reception antennas of the receiver 112 when the first signal is transmitted from a point that is away from a center of the plane by a uniform distance in a direction perpendicular to the plane.

The transmission beam adjustor 130 may determine a phase shift value of 0 degree or 180 degrees to be applied to each signal, according to a value obtained by adding or subtracting a phase shift value of each signal in the signal source virtual beam adjustor 120 to or from a phase shift value of each signal for adjusting a transmission beam under the assumption that signals, to which a phase shift of 0 degree or 180 degrees is to be applied, have the same phase.

The antenna apparatus 200 may include a multi-layer substrate including three main layers; a first main layer of the multi-layer substrate may include the transmitter 140 including a patch antenna and the transmission beam adjustor 130 including a switching element capable of changing a phase of a radiation signal of the patch antenna by 0 degree or 180 degrees; a second main layer under the first main layer may include the signal source virtual beam adjustor 120 including a fixed phase shift section including a delay line; and a third main layer under the second main layer may include the receiver 112 including a reception antenna array.

The antenna apparatus 200 may include a multi-layer substrate including two main layers; a first main layer of the multi-layer substrate may include the transmitter 140 including a patch antenna and the transmission beam adjustor 130 including a switching element capable of changing a phase of a radiation signal of the patch antenna by 0 degree or 180 degrees; a second main layer under the first main layer may include the signal source virtual beam adjustor 120 including a fixed phase shift section including a delay line; and a ground layer under the second main layer may include the receiver 112 including a slot antenna array.

Embodiments of the present disclosure may be written as a program product executable by a computer, and the written program may be stored in a computer-readable recording medium. The computer-readable recording medium includes all recording media such as magnetic media, optical media, ROM, RAM, and the like.

The present disclosure has been described in detail with reference to the preferred embodiments illustrated in the drawings. The embodiments should be considered in a descriptive sense only and not for purposes of limitation. It will be understood by those skilled in the art that these embodiments can be easily modified in other specific forms without changing the technical spirit or essential features of the present disclosure. For example, each element described as a single type may be distributed, and similarly, elements described to be distributed may be combined Although specific terms are used herein, they are used only for the purpose of illustrating the concept of the present disclosure and should not be construed to limit the meaning or are not intended to limit the scope of the present disclosure as defined in the claims. Each operation of the present disclosure need not necessarily be performed in the order described, and may be performed in parallel, selectively, or individually.

The scope of the present disclosure is defined not by the detailed description of the present disclosure but by the appended claims, and all differences within the scope will be construed as being included in the present disclosure. The equivalents include not only currently known equivalents but also those to be developed in future, that is, all devices disclosed to perform the same function, regardless of their structures.

The invention claimed is:

1. An antenna apparatus comprising:

a signal splitter configured to generate a second signal including N equal-phase signals by splitting a first signal received from a signal source;

a signal source virtual beam adjustor configured to generate a third signal including N signals having a virtual focus at one point by shifting a phase of each signal included in the second signal;

a transmission beam adjustor configured to generate a fourth signal including N signals by shifting a phase of each signal included in the third signal by 0 degree or 180 degrees; and a transmitter including N transmission antennas respectively transmitting the N signals included in the fourth signal.

2. The antenna apparatus of claim 1, wherein the signal splitter comprises:

a signal supplier transmitting the first signal; and a receiver including N reception antennas receiving the first signal from the signal supplier, wherein the first signal transmitted from the signal supplier is received at a same phase by the N reception antennas to generate the second signal including the N equal-phase signals by splitting the first signal.

3. The antenna apparatus of claim 2, wherein the N reception antennas are arranged in a radiative near-field region of the signal supplier.

4. The antenna apparatus of claim 2, wherein the N reception antennas are arranged in a plane, and the signal supplier comprises a waveguide configured to transmit the first signal to arrive at the N reception antennas as a plane wave.

5. The antenna apparatus of claim 2, wherein the N reception antennas are arranged in a plane at uniform distances, and the signal supplier comprises N transmission antennas arranged in a plane at the uniform distances.

6. The antenna apparatus of claim 2, wherein the N reception antennas are arranged in a plane at uniform distances, and the signal supplier comprises N transmission antennas arranged in a plane quasi-periodically to correspond to the uniform distances.

7. The antenna apparatus of claim 2, wherein the N reception antennas are slot antennas formed on a ground surface, and the signal source virtual beam adjustor is coupled to the slot antennas via strip lines.

8. The antenna apparatus of claim 2, wherein the antenna apparatus comprises a multi-layer substrate comprising three main layers, wherein a first main layer of the multi-layer substrate includes the transmitter including a patch antenna and the transmission beam adjustor including a switching element capable of changing a phase of a radiation signal of the patch antenna by 0 degree or 180 degrees, a second main layer under the first main layer of the multi-layer substrate includes the signal source virtual beam adjustor including a fixed phase shift section including a delay line, and a third main layer under the second main layer of the multi-layer substrate includes the receiver including a reception antenna array.

9. The antenna apparatus of claim 2, wherein the antenna apparatus comprises a multi-layer substrate comprising two main layers, wherein a first main layer of the multi-layer substrate includes the transmitter including a patch antenna and the transmission beam adjustor including a switching element capable of changing a phase of a radiation signal of the patch antenna by 0 degree or 180 degrees, a second main layer under the first main layer of the multi-layer substrate includes the signal source virtual beam adjustor including a fixed phase shift section including a delay line, and a ground layer under the second main layer of the multi-layer substrate includes the receiver including a slot antenna array.

10. The antenna apparatus of claim 1, wherein the signal source virtual beam adjustor configured to shift the phase of each signal included in the second signal so that the phase of each signal included in the third signal is equal to a phase of the first signal that would reach each of the N transmission antennas when the first signal is transmitted from the one point.

11. The antenna apparatus of claim 1, wherein the N transmission antennas are arranged in a plane at uniform distances, and the signal source virtual beam adjustor configured to shift the phase of each signal included in the second signal so that the phase of each signal included in the third signal is equal to a phase of the first signal that would reach each of the N transmission antennas when the first signal is transmitted from a point that is away from a center of the plane by a certain distance in a direction perpendicular to the plane.

12. The antenna apparatus of claim 1, wherein each value at which the signal source virtual beam adjustor shifts a phase of each signal included in the second signal is a fixed value.

13. The antenna apparatus of claim 12, wherein the signal source virtual beam adjustor shifts a phase of each signal included in the second signal by a fixed value via a delay line.

14. The antenna apparatus of claim 13, wherein a length difference among delay lines with respect to the signals included in the second signal is limited to be within a wavelength.

15. The antenna apparatus of claim 1, wherein the transmission beam adjustor determines a phase shift value of 0 degree or 180 degrees to be applied to each signal, according to a phase shift value of each signal for adjusting a transmission beam under an assumption that the signals included in the third signal have the same phase.

16. The antenna apparatus of claim 1, wherein the transmission beam adjustor determines a phase shift value of 0 degree or 180 degrees to be applied to each signal, according to a value obtained by adding a phase shift value of each signal in the signal source virtual beam adjustor to a phase shift value of each signal for adjusting a transmission beam under an assumption that the signals included in the third signal have the same phase.

17. The antenna apparatus of claim 1, wherein the transmission beam adjustor determines a phase shift value of 0 degree or 180 degrees to be applied to each signal, according to a value obtained by subtracting a phase shift value of each signal in the signal source virtual beam adjustor from a phase shift value of each signal for adjusting a transmission beam under an assumption that the signals included in the third signal have the same phase.

18. The antenna apparatus of claim 1, wherein each of the N transmission antennas is in a form of a rectangular patch having diagonally chamfered edges so that a transmission signal is circularly polarized.

19. An antenna apparatus comprising:

a receiver comprising N signal receivers;

a signal source virtual beam adjustor configured to shift a phase of each of N signals received by the N signal receivers to have a virtual focus at one point;

a transmission beam adjustor configured to shift a phase of each of the N signals that are phase-shifted by the signal source virtual beam adjustor, by 0 degree or 180 degrees; and a transmitter comprising N transmission antennas respectively transmitting the N signals that are phase-shifted by the transmission beam adjustor.

20. The antenna apparatus of claim 19, wherein, when a same first signal is received by the N signal receivers, the signal source virtual beam adjustor shifts the phase of each of the N signals received by the N signal receivers so that the phase of each of the N signals that are phase-shifted by the signal source virtual beam adjustor is equal to a phase of the first signal that would reach each of the N transmission antennas arranged in a plane when the first signal is transmitted from the one point.

* * * * *